US007703946B2

(12) United States Patent
Chiang et al.

(10) Patent No.: US 7,703,946 B2
(45) Date of Patent: Apr. 27, 2010

(54) LED WALL WASH LIGHT

(75) Inventors: Lee Chiang, Sylmar, CA (US); Xin Guo, Torrance, CA (US); Eng K. Wong, Torrance, CA (US); Yupin Sun, Yorba Linda, CA (US)

(73) Assignee: Display Products, Inc., El Segundo, CA (US)

( * ) Notice: Subject to any disclaimer, the term of this patent is extended or adjusted under 35 U.S.C. 154(b) by 0 days.

(21) Appl. No.: 12/154,471

(22) Filed: May 23, 2008

(65) Prior Publication Data

US 2009/0290344 A1 Nov. 26, 2009

(51) Int. Cl.
*F21V 21/00* (2006.01)

(52) U.S. Cl. ..... 362/249.02; 362/249.01; 362/800; 362/294

(58) Field of Classification Search ..... 362/800, 362/249.1, 249.02, 373, 294
See application file for complete search history.

(56) References Cited

U.S. PATENT DOCUMENTS

| | | | | |
|---|---|---|---|---|
| 7,212,344 | B2 * | 5/2007 | Keuper et al. | 359/618 |
| 7,237,925 | B2 * | 7/2007 | Mayer et al. | 362/247 |
| 7,482,633 | B2 * | 1/2009 | Chiaretti | 257/89 |
| 7,524,097 | B2 * | 4/2009 | Turnbull et al. | 362/545 |
| 7,553,051 | B2 * | 6/2009 | Brass et al. | 362/373 |
| 2003/0043590 | A1 * | 3/2003 | Walser et al. | 362/494 |
| 2007/0041220 | A1 * | 2/2007 | Lynch | 362/646 |

* cited by examiner

*Primary Examiner*—Anabel M Ton
(74) *Attorney, Agent, or Firm*—Stockwell & Smedley, PSC

(57) ABSTRACT

Embodiments of the present invention relate to an LED light fixture that linearly arranges a plurality of LEDs within a housing such that each LED has a respective collimator. The output from the collimators is directed to a diffuser that shapes the light provided by the fixture so that a desired viewing angle is achieved. More particularly, the LEDs are located on a first circuit board and the driver chips for the LEDs are located on a second circuit board which sandwich a heat sink.

17 Claims, 2 Drawing Sheets

LED WALL WASH LIGHT

BACKGROUND OF THE INVENTION

1. Field of the Invention

The present invention relates generally to an architectural light and, more particularly, to an LED architectural light.

2. Description of Related Art

There are a variety of lights and lighting fixtures presently on the market. Their intended uses range from such diverse environments as indoor lighting to outdoor stadium lighting. One particular type of lighting system is intended to accent architectural details and are often call wall wash lights. Such lights attempt to illuminate all or portions of a structure (typically outside, but inside uses exist as well.)

In many instances the intended effect of the light is to combine with an architectural feature so that the combination of the light and the feature is impressive, eye-catching, or artistically attractive. The lights are typically located in such a way that their effect is seen but not their location so as to augment the aesthetics of their use. Incandescent and fluorescent lights have typically been used in these applications because they provide the necessary amounts of illumination capable of brightly lighting a large area. However, high intensity LEDs have recently become preferable to replace the incandescent or fluorescent lights because of LEDs adequate light output and lower power consumption.

However, simply replacing a conventional light bulb with an LED is not possible and current LED architectural lighting systems continue to have a number of technical challenges that must be overcome to perform technically, effectively, and efficiently. For example, while there is always some operating voltage for an LED, it is the current rather than the voltage that is proportional to the brightness attainable by the LED. Merely increasing the current to achieve brightness raises a number of issues such as overheating, reduced component lifetime, power inefficiencies, and safety. These shortcomings are important because in many instances lights of this type are placed in locations and environments where replacement or repair is impossible or prohibitively expensive (e.g., on the side of a skyscraper).

Thus, there remains a yet unfulfilled need for LED-based architectural lights that are simple to manufacture, that allow easy customization by an end-user, that provide reliable performance, and that can withstand the environment in which they are placed.

BRIEF SUMMARY OF THE INVENTION

Embodiments of the present invention relate to an LED light fixture that linearly arranges a plurality of LEDs within a housing such that each LED has a respective collimator. The output from the collimators is directed to a diffuser that shapes the light provided by the fixture so that a desired viewing angle is achieved. More particularly, the LEDs are located on a first circuit board and the driver chips for the LEDs are located on a second circuit board which sandwich a heat sink.

It is understood that other embodiments of the present invention will become readily apparent to those skilled in the art from the following detailed description, wherein it is shown and described only various embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF DRAWINGS

Various aspects of a LED wall wash light are illustrated by way of example, and not by way of limitation, in the accompanying drawings, wherein.

DETAILED DESCRIPTION OF INVENTION

The detailed description set forth below in connection with the appended drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details. In some instances, well known structures and components are shown in block diagram form in order to avoid obscuring the concepts of the invention.

In the embodiments described herein, the term "wall wash light" is used but is not intended to limit the present invention to only illuminating walls or flat surfaces. In addition to those uses, lights in accordance with the present invention may be used in almost any configuration to illuminate an architectural detail, a sculpture, a fence, etc. Also, in many instances, specific commercially available part numbers are provided by way of example only. These specific parts are identified in order to highlight the type of capabilities and characteristics that are incorporated in various embodiments of the present invention. However, one of ordinary skill will recognize that different parts may be substituted without departing from the scope of the present invention and new and improved parts as they become available will provide additional benefits and efficiencies within embodiments of the present invention.

Figure 1:
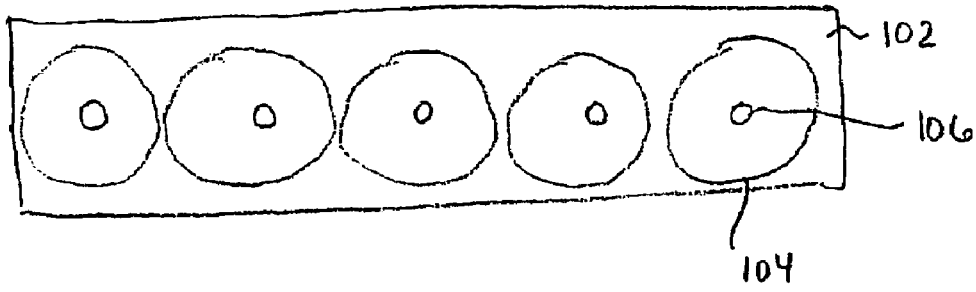
FIG. 1 shows a top view of an internal circuit board for use in accordance with the principles of the present invention.

FIG. 1 illustrates a circuit board 102 for use in accordance with the principles of the present invention. The circuit board 102 supports the LEDs 106 and collimators 104 that are part of the present invention. In particular, a number of a high-intensity LEDs 106 are spaced along the length of the circuit board 102. On top of each of these LEDs 106 is a separate collimator 104. In many applications, identical LEDs 106 are used along the circuit board 102 as well as identical collimators 104. However, in some embodiments, the collimators 104 and LEDs 106 may vary to provide additional functionality to the system.

One exemplary LED that is currently available that is appropriate for use with at least some embodiments of the present invention is Cree XLamp® XR-E LEDs. These LEDs are available in a variety of color temperatures and operating parameters that allow customization of the present system to many different intended uses. As mentioned above, the identification of a particular LED is not intended to limit embodiments or aspects of the present invention to merely this particular (or a substantially similar) LED; it is merely an acknowledgement that LEDs of this type are suitable for embodiments of the present invention.

The choice of the collimators 104 are dependent on the LEDs 106. For example, each collimator 104 physically fits around the LED 106 and is of a material and a construction that matches the type of spectrum produced by the LED 106. Example collimators can include, but are not limited to, those manufactured by FRAEN. One such collimator is the FC-N2-XR79-HRF model which has mechanical and optical characteristics that match well with the Cree LEDs identified earlier.

The side view of the device 200 more clearly shows some of the components which are attached to the circuit board 102. As in FIG. 1, the LED's 106 and collimators 104 are shown dispensed along the length of the board 102. Also present is a heat sink 202 and another circuit board 204. In operation, power and control signals are supplied to the device 200 such that the LEDs 106 illuminate at a desired brightness. The driver chips 206 which supply the operating current to the LEDs 106 produce the greatest amount of heat compared to the other electronic components (210, 212) that control operation of the LEDs 106. The LEDs 106, themselves, generate a lot of heat as well compared to the other components.

Thus, the driver chips 206 are connected with the heat sink 202 and the circuit board 102 is connected to the heat sink as well. The heat sink can be constructed out of any material that helps with the dissipation of heat such as, for example, aluminum. The connection of the circuit board 102 to the heat sink 202 can be mechanical in nature (e.g., clamps, screws, etc.) or it can be accomplished using an adhesive that helps transmit heat from the circuit board 102 to the sink 202. Also, through-vias may be formed through the circuit board 102 and lined with metal to augment the heat transfer from the circuit board 102 to the heat sink 202. Similarly, the driver chips 206 may be bonded to the heat sink 202 with a material 208 that assists with heat transfer. Alternatively, this additional material 208 can be omitted so that the driver chips 206 are in direct contact with the heat sink 202. Thus, the circuit board 204 can be a two sided circuit board with the high temperature components on one side to take advantage of the heat sink 202 and the low-temperature components isolated on the other side of the circuit board 202.

Figure 2:
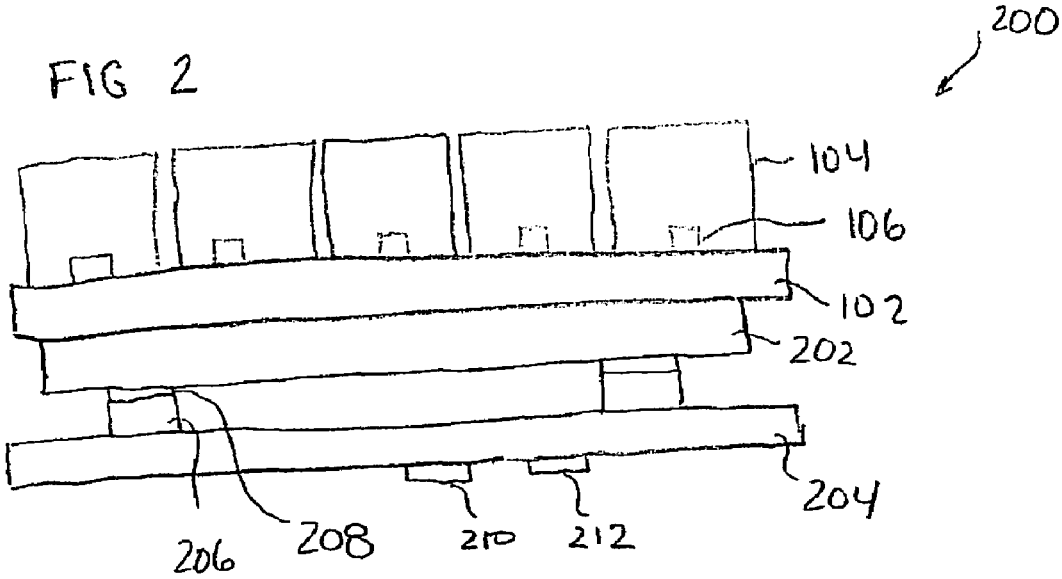
FIG. 2 shows a side view of more components of a circuit board for use in accordance with the principles of the present invention.

As for size and placement of the components illustrated in FIGS. 1 and 2, various design changes can be made without departing from the scope of the present invention. However, in many practical uses wall wash systems are intended to be unobtrusive and, therefore, sleek and compact arrangements are beneficial. For example the height and width of the device 200 is preferably less than about 2 or 2.5 inches in each such dimension. At this compact of a size, heating of the device 200 is a concern and the components work in synergy with one another to help overcome any deleterious effects of such heating. The length of the circuit board 102 may be any of several dimension with the components selected to optimize power per foot while balancing the heat generated to provide that power.

Using the example components described above, embodiments of the present invention can reliably perform while consuming power at about 17 W per foot when 12 LEDs are used per foot. Thus, in FIG. 1, where there are five collimators 104 and five LEDs 106 shown, they would be spaced roughly a inch apart so that twelve could fit on a circuit board 102 that is one foot in length. Such an arrangement would provide approximately 850 lumens per foot for cool white and about 600 lumens per foot for warm white. Utilizing 12 LEDs per foot is merely an example and different densities of LEDs may be used such as, for example, only six LEDs per foot. In the case where only 6 LEDs are used per foot along the circuit board, then the power consumption would be roughly 8 W per foot.

The height of the collimators 104 affects the overall size of the device 200 as well. The purpose of the collimator is to provide as much of each LED's light as possible for the application at hand and to make it possible for a secondary diffuser to reshape light at desired beam angles. Although the term collimator, in general, has been used to refer to any lens that narrows an LED light beam, the collimators described herein are such that the beam angle of the light output from the collimators are as narrow as possible. Thus, the size, shape and optical efficiency are all attributes of the collimator which determines its selection as a component. Because of product size considerations a shorter collimator is better; however, it is also preferred that the optical efficiency approaches or exceeds about 90%. The example FRAEN collimator identified above has a diameter of about 21 mm and a height of about 15 mm and can be attached with adhesive to the circuit board 102 to surround each respective LED 106.

Figure 3:
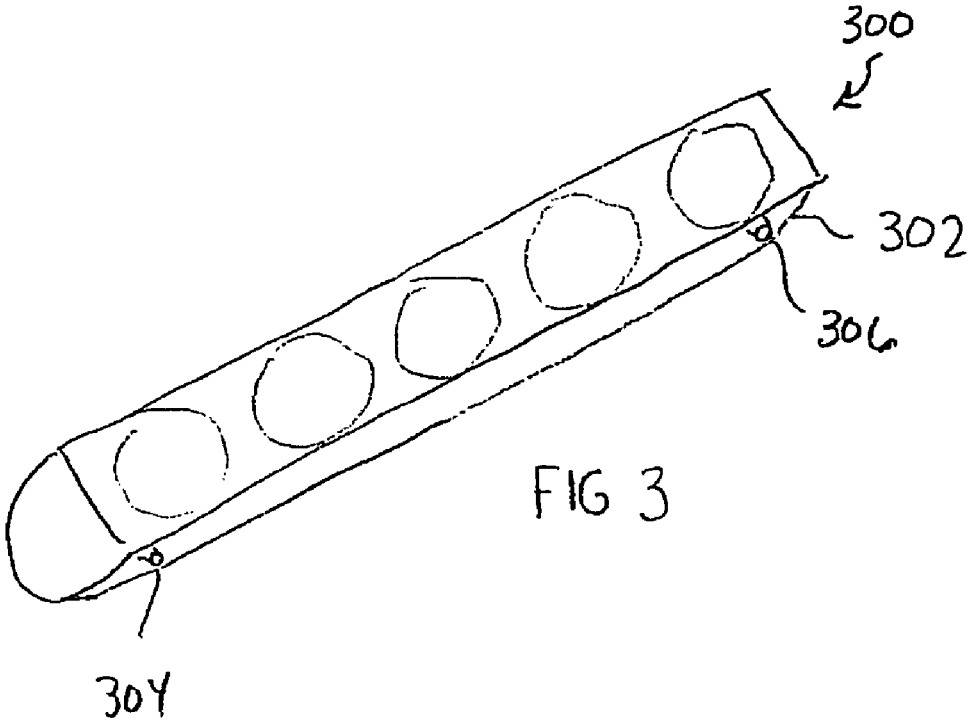
FIG. 3 depicts a wall wash light housing in accordance with the principles of the present invention.
Figure 4:
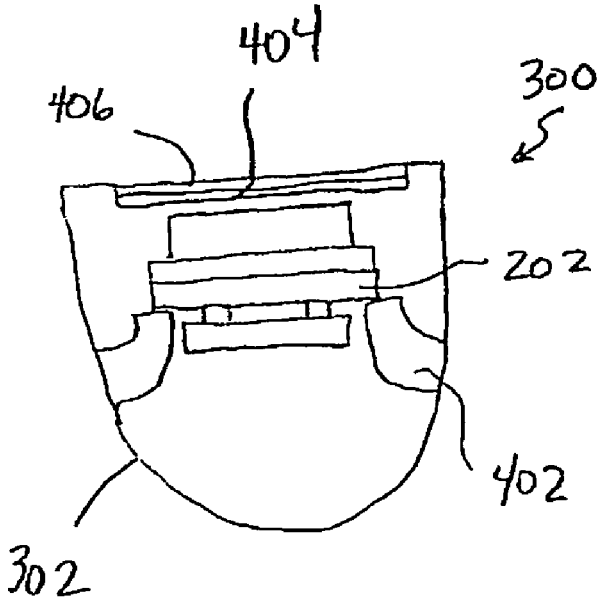
FIG. 4 shows a side cut-away view of the housing of FIG. 3.

FIG. 4 depicts a close-up view of a cutaway of the unit 300 shown in FIG. 3. In particular, a number of features are shown which are not clearly visible in the previously described figures. One such feature is the diffuser 404, this diffuser extends the length of the housing 302 and receives the light from the different collimators and shapes it to a specific shape. As shown, the acrylic window 406 provides a flush top to the unit 300. Such a flush top ensure that dirt and debris does not collect in any crevice or depression and that rainwater or spraying with a hose will cause water to clean the surface and drain away without pooling. One practical way of accomplishing this flush top is to seat the diffuser 404 under an acrylic (or similar material) window 406 within a channel in the housing 302 and seal it with a watertight sealant (e.g., RTV sealant). The other components of the housing 302 may be coupled together with similar sealant or with mechanical fasteners and gaskets in order to provide a water-tight seal if desired. The water-tight seal described herein at least meets IP-67 guidelines.

The diffuser 404 is selected to provide a lighting prescription that a customer may specify. One example diffuser 404 material that may be used is described in U.S. Pat. No. 5,365,354; however, one of ordinary skill will recognize that other diffusers may be selected without departing from the scope of the present invention. Selection of the diffuser 404 is one of the particular benefits of the present invention. The same housing 302 and circuit assembly 200 may be used with any of a number of diffusers that may be selected based on a customer's desires. Thus, embodiments of the present system allows light of many different viewing angles to be provided by the same basic design by substitution of an appropriate diffuser 404. In addition to the diffuser 404 shown in FIG. 4, another light bending film may be inserted underneath the diffuser to create non-symmetric viewing angles as well. In yet another alternative, the acrylic shield may be removable, or contain a chamber or slot, such that a second diffuser may substituted for the original diffuser if a different viewing angle is desired. If generally white LEDs are used, colored filters may be attached above or below the window 406 as well so that a different colored lights can be produced simply by changing the color of the filter. However, another approach that is more efficient is to use a desired color LED along with the translucent diffuser.

The device or assembly 200 is shown within its housing 302 in FIG. 3 that forms a wall wash light 300 in accordance with the principles of the present invention. The housing is selected to be constructed from a material that is lightweight, extruded (e.g., easy to manufacture in different lengths), and a good heat dissipater. Aluminum fits all these criteria but other, similar, materials may be used as well without departing from the scope of the present invention. The housing 302 preferably provides a water-tight enclosure for the device 200 and such a sealed unit further emphasizes the importance of the other components to effectively handle the heat being generated during operation.

One or two connectors (304, 306) are provided so that necessary power and signals can be provided to the unit 300. Presently, there are various 0-10V control systems for operating different lighting fixtures such that dimming and other features can be provided manually (e.g., potentiometer) or automatically (e.g., PLC control or the like). Embodiments of the present invention are designed to operate under control of such systems. Also a non-proprietary 24 VDC power supply can be used to provide the necessary power to operate the unit 300. The power supply signals and operating signals can then be provided to a connector 304 using various arrangements of flexible cables. Furthermore, a similar cable can be used to connect one unit 300 to another so that the units can be daisy chained together. Because the connections are with a flexible cable, the units 300 can each be positioned differently when installed at a particular location. In other words, they are not required to be in a rigid, straight line orientation but may be located at various angles to one another. Furthermore, this daisy-chaining arrangement is an arrangement of peers rather than some type of master slave arrangement. Thus, the power supply and control signals can be connected to either end of the daisy chain and function exactly the same.

One of the benefits of the present invention is that housings 302 of various lengths may be easily produced. For example, the housing 302 may be extruded in one-foot through four-foot lengths. While circuit boards 102 and 204 may also be constructed in a length to match that of the housing 302, the design of the present invention allows for an easier method of fabrication. Multiple assemblies 200 may be constructed in one-foot lengths and then daisy chained together within the housing 302 as needed. For example, if a three-foot housing 302 was manufactured, then three one foot assemblies 200 could be connected together inside the housing 302.

The housing 302 includes structures 402 within the housing that transfer heat from the heat sink 202 to the relatively larger housing 302. Thus, when the assembly 200 is installed within the housing 302, the heat sink 202 is arranged to be coupled with the structures 402. This coupling can be achieved by any of a number of functionally equivalent methods without departing from the scope of the present invention.

In addition to single color LEDs, embodiments of the present invention are contemplated that utilize RGB LEDs. In this case, addition control lines are used to control the brightness and the color produced by the LEDs.

As described above, a modular LED wall wash fabrication method allows for customized wall wash lights to be easily manufactured. First, the same circuit boards are used regardless of the desired length of the fixture. Secondly, one type of LED may be substituted for another without changing significant parts of the fixture. Thirdly, different collimators can be substituted as improvements are made or as different light behavior is desired. Fourthly, the selection of an appropriate diffuser allows the same general fixture to be used to produce any of a number of desired viewing angles. Fifthly, multiple fixtures can be daisy chained together in a flexible arrangement that does not require a dedicated master/slave relationship or require linear arrangement of the fixtures. Thus, a manufacturer has great flexibility in supplying a customized light fixture by offering the selection of lengths, connectors, viewing beam angles, power, and LED color (or warmth).

The previous description is provided to enable any person skilled in the art to practice the various embodiments described herein. Various modifications to these embodiments will be readily apparent to those skilled in the art, and the generic principles defined herein may be applied to other embodiments. Thus, the claims are not intended to be limited to the embodiments shown herein, but are to be accorded the full scope consistent with each claim's language, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A light fixture comprising:
- a housing;
- a plurality of LEDs connected to a first circuit board;
- a respective collimator for each of the plurality of LEDs, the collimators configured to direct light from the LEDs towards a top of the housing;
- a plurality of driver chips for the LEDs connected to a second circuit board;
- a heat sink sandwiched between the first circuit board and the second circuit board; and
- a diffuser between the collimators and the top of the housing configured to shape light exiting the housing.

2. The light fixture of claim 1, wherein the housing includes a major axis and the LEDs are arranged generally linearly along this major axis.

3. The light fixture of claim 2, wherein a respective collimator is bonded to the circuit board so as to surround a respective LED.

4. The light fixture of claim 2, wherein the LEDs are arranged about one inch apart.

5. The light fixture of claim 2, wherein the LEDs are arranged about two inches apart.

6. The light fixture of claim 1, wherein the light fixture provide about 850 lumens per foot.

7. The light fixture of claim 1, further comprising:
- a first electrical connector configured to be coupled with a power signal and the LEDs.

8. The light fixture of claim 7, wherein the first electrical connector is further configured to be coupled with a dimming control signal.

9. The light fixture of claim 8, further comprising:
- a second electrical connector configured to supply as output the power signal and the dimming control signal.

10. The light fixture of claim 1, further comprising:
- a structure within the housing configured to communicate with the heat sink such that heat is transferred from the heat sink to the housing.

11. The light fixture of claim 1, further comprising:
- a shield configured to protect the diffuser and provide an outer top surface for the housing.

12. The light fixture of claim 11, wherein the outer top surface is a flush surface.

13. The light fixture of claim 11, wherein the housing and shield provide a water-tight enclosure.

14. A light fixture comprising:

a housing;

at least one light assembly within the housing comprising:

a plurality of LEDs connected to a first circuit board;

a respective collimator for each of the plurality of LEDs, the collimators configured to direct light from the LEDs towards a top of the housing;

a plurality of driver chips for the LEDs connected to a second circuit board; and a heat sink sandwiched between the first circuit board and the second circuit board; and a diffuser between the collimators and the top of the housing configured to shape light exiting the housing; and a shield configured to protect the diffuser and provide an outer top surface for the housing.

15. The light fixture of claim 14, further comprising:

at least two light assemblies in electrical communication with one another.

16. The light fixture of claim 14, further comprising:

a structure within the housing configured to communicate with the heat sink such that heat is transferred from the heat sink to the housing.

17. The light fixture of claim 14, wherein power consumption is about 17 W for each light assembly and the light fixture provides about 850 lumens per foot.

* * * * *